US005233726A

United States Patent [19]

Cress

[11] Patent Number: 5,233,726

[45] Date of Patent: Aug. 10, 1993

[54] CONCEALED SELF-CLOSING/SELF-LATCHING HINGE

[75] Inventor: David R. Cress, Janesville, Wis.

[73] Assignee: Amerock Corporation, Rockford, Ill.

[21] Appl. No.: 844,190

[22] Filed: Mar. 2, 1992

[51] Int. Cl.[5] ..... E05D 11/10

[52] U.S. Cl. ..... 16/336; 16/DIG. 13

[58] Field of Search ..... 16/321, 322, 324, 325, 16/333, 335, 336, 341, 343, DIG. 13, 332

[56] References Cited

U.S. PATENT DOCUMENTS

| | | | |
|---|---|---|---|
| 2,526,209 | 10/1950 | Durup | 16/142 |
| 3,103,378 | 9/1963 | Ahlgren | 292/17 |
| 3,418,682 | 12/1968 | Anderson | 16/145 |
| 3,724,021 | 4/1973 | Lautenschlaeger | 16/163 |
| 3,831,989 | 8/1974 | Gurenda | 16/336 |
| 3,864,786 | 2/1975 | Salice | 16/163 |
| 4,063,330 | 12/1977 | Triplette | 16/142 |
| 4,240,179 | 12/1980 | Lautenschlager, Jr. | 16/139 |
| 4,247,965 | 2/1981 | Lautenschlager | 16/145 |
| 4,716,622 | 1/1988 | DeBruyn | 16/297 |
| 5,027,474 | 7/1991 | Bowers | 16/297 |
| 5,060,344 | 10/1991 | Cress | 16/332 |

FOREIGN PATENT DOCUMENTS

| | | | |
|---|---|---|---|
| 116224 | 7/1989 | China . | |
| 116515 | 7/1989 | China . | |
| 141963 | 9/1990 | China . | |
| 2330207 | 1/1975 | Fed. Rep. of Germany | 16/335 |
| 2439314 | 2/1976 | Fed. Rep. of Germany | 16/336 |
| 2828052 | 1/1980 | Fed. Rep. of Germany | 16/336 |
| 2005853 | 12/1969 | France | 16/335 |

*Primary Examiner*—Lowell A. Larson
*Assistant Examiner*—Donald M. Gurley
*Attorney, Agent, or Firm*—Leydig, Voit & Mayer

[57] ABSTRACT

A concealed hinge with a door member having a cup which fits into a pocket in the inner face of a cabinet door, the door member and the cup being molded of plastic. Two cantilevered spring fingers are molded integrally with and are located in the cup. As the door is swung closed, the spring fingers coact with a cam on the frame member of the hinge to effect self-closing and self-latching of the door.

9 Claims, 2 Drawing Sheets

CONCEALED SELF-CLOSING/SELF-LATCHING HINGE

BACKGROUND OF THE INVENTION

This invention relates generally to a self-latching, and preferably self-closing, hinge for mounting a cabinet door for swinging between closed and open positions on a cabinet frame. More specifically, the invention relates to a concealed hinge of the same general type as disclosed in DeBruyn U.S. Pat. No. 4,716,622 and Bowers U.S. Pat. No. 5,027,474.

In hinges of this type, the door member of the hinge is, for the most part, formed by a cup which is adapted to nest within a pocket formed in the inner side of the door. A hinge pin is supported by the cup and is connected to the frame member of the hinge in order to mount the cabinet door for swinging between closed and open positions. When the door is closed, virtually all parts of the hinge are concealed from view from the front of the cabinet.

The hinges of the DeBruyn and Bowers patents are self-closing and self-latching in that, after the door has been swung part way closed, spring means cause the door to swing the rest of the way closed and resiliently hold the door in its closed position. While such hinges have experienced significant success, they are somewhat expensive in that the spring and the cup of the door member are separately formed components and must be assembled with one another. In addition, the spring acts on the frame member of the hinge adjacent the hinge pin and requires that special procedures be used to assemble the door and frame members.

Lautenschlager, Jr. U.S. Pat. No. 3,724,021; Salice U.S. Pat. No. 3,864,786 and Lautenschlager U.S. Pat. No. 4,247,965 disclose hinges having door cups molded of plastic and formed with integrally molded springs for effecting a self-closing/self-latching action. These hinges, however, are bulky, present an unattractive appearance and experience a relatively short service life.

SUMMARY OF THE INVENTION

The general aim of the present invention is to provide a new and improved concealed and self-latching cup-type hinge in which the door member is molded as a compact and attractive single piece unit having durable and reliable integral spring means for effecting the self-latching action.

A further object of the invention is to provide such a hinge in which the spring means also effects a self-closing action.

A more detailed object is to achieve the foregoing through the provision of a hinge in which two arcuate springs are compactly cantilevered within the cup of the door member and coact uniquely with novel cam means on the frame member to effect a self-closing/self-latching action as the door is swung toward its closed position.

Still another object of the invention is to provide a hinge having integral springs located internally of a molded cup whose outer side is adapted to be closed by an integral hinged cover following molding of the cup.

These and other objects and advantages of the invention will become more apparent from the following detailed description when taken in conjunction with the accompanying drawings.

DETAILED DESCRIPTION OF THE PREFERRED EMBODIMENT

Figure 1:
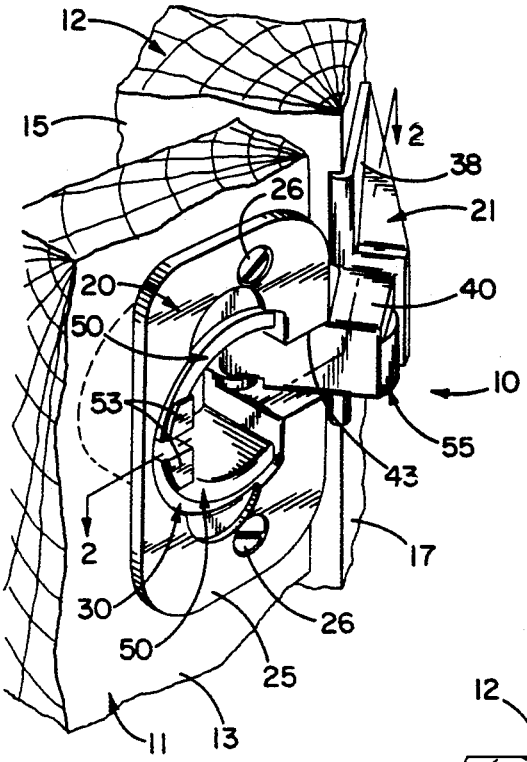
FIG. 1 is a fragmentary perspective view showing a cabinet door swingably mounted on a cabinet frame by a new and improved hinge incorporating the unique features of the present invention.

For purposes of illustration, the hinge 10 of the present invention is shown in the drawings as being used for mounting a substantially solid door 11 made of wood or other non-metallic material for swinging between open and closed positions on the frame 12 of a kitchen cabinet. In this instance, the door is of the overlay type in that, when the door is closed, the inner and outer face surfaces 13 and 14 (FIG. 5) of the door overlap the outer face surface 15 of the frame while the hinged edge surface 16 of the door is spaced laterally from the adjacent parallel edge surface 17 of the frame.

Figure 2:
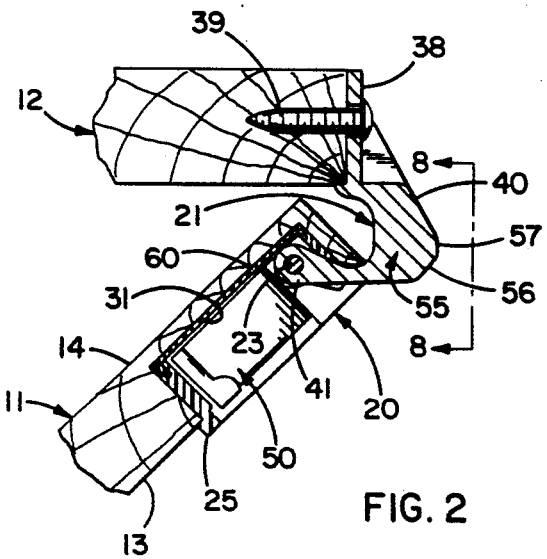
FIG. 2 is a fragmentary cross-section taken substantially along the line 2—2 of FIG. 1 and shows the door in a fully open position.

The hinge 10 comprises door and frame members 20 and 21 adapted to be mounted on the door 11 and the frame 12, respectively, and connected by an upright hinge pin 23 (FIG. 2) which serves to mount the door member for swinging relative to the frame member. The door member 20 is injection molded from a relatively hard but resiliently yieldable plastic such as Delrin. As shown most clearly in FIG. 1, the door member includes a flat mounting plate or flange 25 adapted to lie against the inner face surface 13 of the door 11, the flange being secured to the door by a pair of vertically spaced screws 26 extending through holes 27 (FIG. 7) in the flange. Molded integrally with and projecting outwardly from the mounting flange is a generally circular cup 30. A cylindrical bore or pocket 31 (FIG. 2) is formed in the inner face surface 13 of the door, terminates short of the outer face surface 14 thereof, and snugly receives the cup.

Herein, the cup 30 includes an annular side wall formed in part by an arcuate portion 33 (FIG. 7) which extends through an arc of about 250 degrees, the ends of the arcuate portion being located near the hinge pin 23. The side wall further includes radial portions 34 extending transversely into the cup 30 from the ends of the arcuate portion, and also includes leg portions 35 disposed at right angles to the radial portions. Completing the side wall is a second substantially arcuate portion 36 which extends between the leg portions 35. The arcuate portion 36 is approximately the same radius as but is substantially shorter than the arcuate portion 33 and coacts with the latter to keep the cup 30 seated snugly in the pocket 31.

Figure 5:
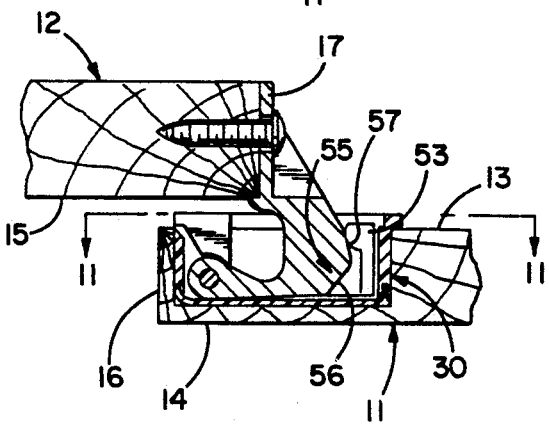
Figure 8:
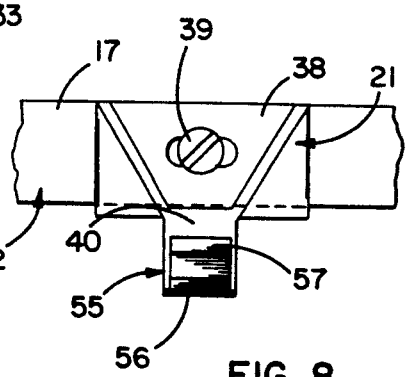
FIG. 8 is a fragmentary elevational view of the frame member of the hinge as seen along the line 8—8 of FIG. 2.

In this instance, the frame member 21 of the hinge 10 is die cast from metal and includes a mounting wing 38 (FIGS. 1, 2 and 8) which lies against the edge surface 17 of the frame 12 and which is fastened thereto by a screw 39. A generally L-shaped arm 40 is formed integrally with the wing and extends into the cup 30. A knuckle 41 on the free end of the arm fits between the leg portions 35 of the side wall of the cup and is formed with a hole for tightly receiving the hinge pin 23 with a press fit. The end portions of the hinge pin are rotatably received by vertically extending holes 42 (FIGS. 6 and 7) formed through the leg portions 35. As the door 11 is opened and closed, the door member 20 of the hinge 10 turns on the fixed hinge pin. When the door is fully closed, virtually all of the arm 40 is located within the cup 30 as shown in FIG. 5. When the door is fully open, a notch 43 (FIG. 1) in the flange 25 accommodates the arm.

In accordance with the present invention, two springs 50 are molded integrally with the cup 30, are disposed entirely within the cup and effect a self-closing/self-latching action as the door 11 is swung toward its closed position. The springs 50 are compact, remain reliable after many repetitive cycles, and do not adversely affect the appearance of the door member 20 of the hinge.

Figure 7:
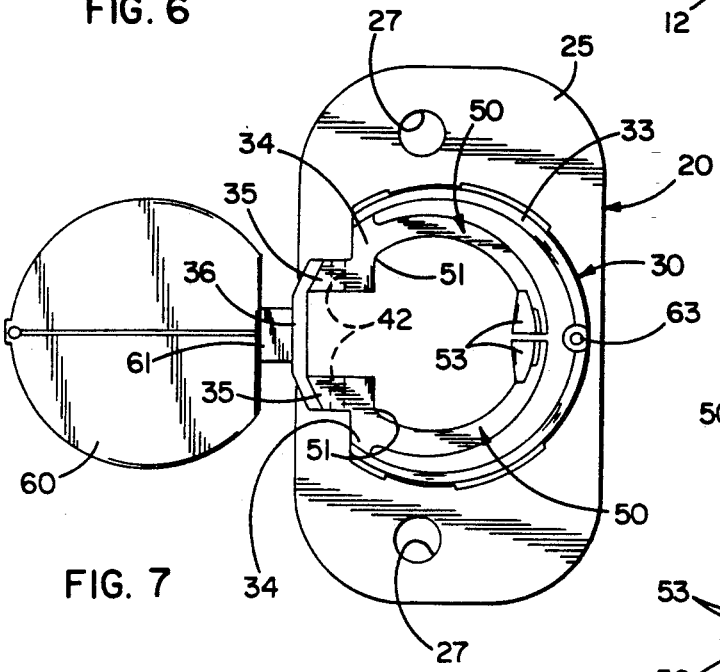
FIG. 7 is a front view of the door member shown in FIG. 6.

In this particular instance, each of the springs 50 is in the form of a finger having a width just somewhat less than the width of the arcuate portion 33 of the side wall of the cup 30. The spring fingers 50 are molded integrally with and extend cantilever fashion from the radial portions 34 of the side wall as shown in FIG. 7, the fingers being joined to the radial portions at 51. Each finger is generally arcuate, is substantially concentric with the arcuate portion 33 of the cup and is inset slightly from the arcuate portion both at the inner side of the cup and at the outer side thereof.

The two fingers 50 include free ends which are disposed in spaced opposing relation to one another and which are located approximately 180 degrees from the hinge pin 23. Molded integrally with the free end portion of each finger is a detent lug 53 which is formed with a rounded surface.

The fingers 50 and the detent lugs 53 coact with a cam 55 which is formed on the arm 40 of the frame member 21 of the hinge 10. Herein, the cam is in the form of a nose which is located about midway between the ends of the arm 40. The nose includes a first sloping cam surface 56 which faces generally outwardly and further includes a second and oppositely sloped cam surface 57 which faces generally inwardly. The slope of the cam surface 56 is somewhat greater than that of the cam surface 57. In addition, each cam surface is radiused as shown in FIG. 9 so as to define a generally vertically extending arc in cross-section.

Figure 3:
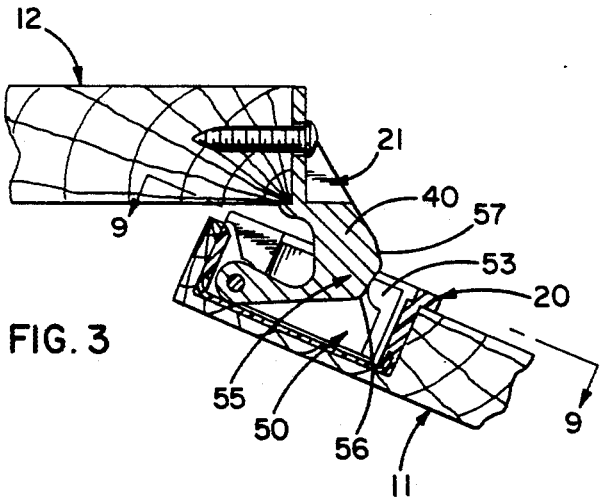
FIGS. 3, 4 and 5 are views generally similar to FIG. 2 but show successive positions of certain components of the hinge during closing of the door.
Figure 9:
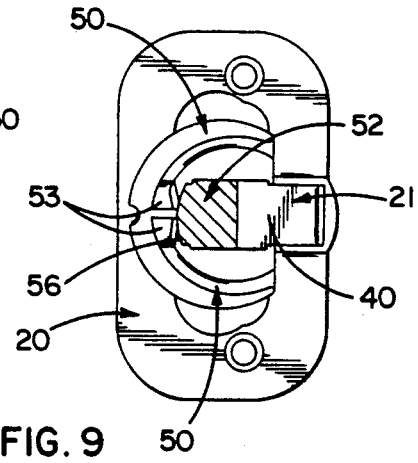
FIG. 9 is a cross-sectional view taken along the line 9—9 of FIG. 3.
Figure 10:
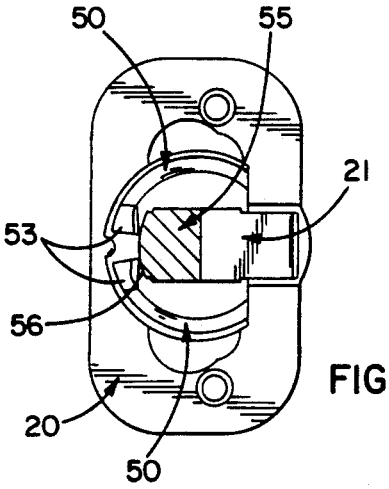
FIG. 10 is a cross-sectional view taken along the line 10—10 of FIG. 4.

FIGS. 3 and 9 show the hinge 10 when the door 11 is closed to such a position that the detent lugs 53 first contact cam surfaces 56 of the nose 55. As illustrated in FIG. 9, the opposing ends of the two spring fingers 50 are spaced closely together and, in this position of the door, the spring fingers are in a relaxed and unstressed condition. As the door is closed further to the position shown in FIGS. 4 and 10, the lugs 53 ride along the sloped cam surface 56 and produce a camming action which wedges the ends of the fingers 50 away from one another (compare FIGS. 9 and 10). This flexes the fingers about the cantilevered connections 51 and causes the fingers to be resiliently loaded.

Figure 4:
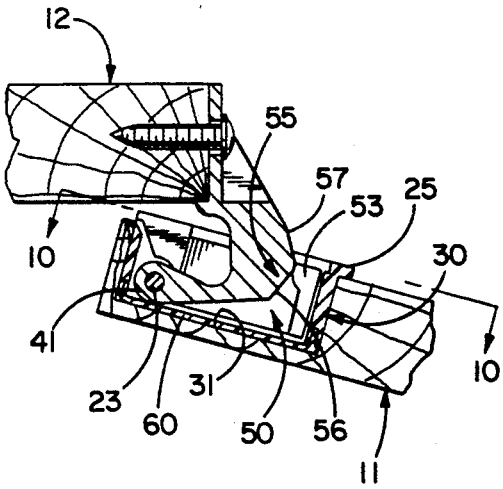
Figure 11:
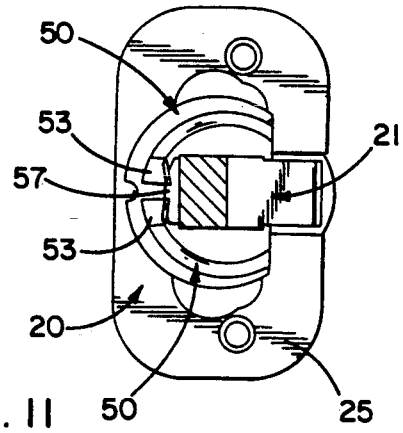
FIG. 11 is a cross-sectional view taken along the line 11—11 of FIG. 5.

With further closing of the door 11 beyond the position shown in FIG. 4, the lugs 53 leave the cam surface 56 and pass along the oppositely sloped cam surface 57. The fingers 50 tend to spring back to their normal positions and, as a result, the pressure exerted by the lugs 53 against the cam surface 57 causes the door to snap to its fully closed position shown in FIG. 5, the self-closing action occurring during approximately the final 12 degrees of closing of the door. When the door is fully closed, the lugs are positioned as shown in FIGS. 5 and 11 and, being still under some spring load, resiliently engage the cam surface 57 to releasably hold the door 11 in its closed position.

When the door 11 is opened, some resistance is encountered until the lugs 53 leave the cam surface 57. Thereafter, the door opens freely.

From the foregoing, it will be apparent that the self-closing/self-latching action is produced by the coaction of the two cantilevered spring fingers 50 with the cam 55. The spring fingers are molded integrally as part of the overall door member 20 and do not require separate assembly. Moreover, the entire hinge 10 consists of only three components, namely, the door member 20, the frame member 21 and the hinge pin 23. When the door and frame members are assembled to one another by the hinge pin, there is no interference by the spring fingers 50 and thus the assembly may be effected in a comparatively simple manner.

Because the spring fingers 50 are molded within the cup 30, the front side of the cup must be left open during the molding operation in order to enable the components of the molding tool to enter the cup and form the fingers. From an aesthetic standpoint, it is desirable for the front of the cup to be closed in order to conceal the wood or other material at the bottom of the bored pocket 31 in the door 11. Advantageously, closing of the front of the cup is effected by an integral cover 60 which, after molding of the door member 20, is folded over to a closed position with respect to the front side of the cup 30.

Figure 6:
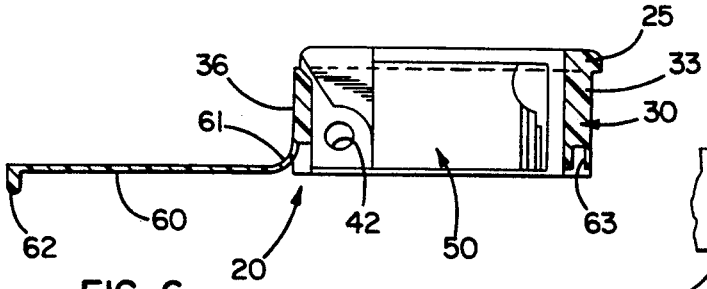
FIG. 6 is a cross-sectional view of the door member of the hinge and shows the member after molding but before closing of the front of the cup of the door member.

The cover 60 is shown in its as-molded position in FIGS. 6 and 7 and, as illustrated, the cover is simply a thin web of plastic having a generally D-shaped configuration. The straight side of the cover is connected to the arcuate portion 36 of the side wall of the cup by a flexible hinge strap 61.

When the door member 20 is molded, the cover 60 extends outwardly from the cup 30 as shown in FIGS. 6 and 7. After molding of the door member, the cover is simply folded over against the front side of the cup as permitted by the hinge strap 61 and thus the cover closes the front side of the cup. When the cover is folded over, a pin 62 adjacent the free edge of the cover telescopes into a hole 63 in the cup with a tight press fit in order to secure the cover in its closed position. Alternatively, the pin may be ultrasonically welded in the hole in order to hold the cover in place.

I claim:

1. A concealed self-latching hinge for mounting a door for swinging between open and closed positions on a fixed frame, said hinge comprising a door member and a frame member mountable on said door and said frame, respectively, pivot means pivotally interconnecting said door member and said frame member to enable said door to swing between said positions, said door member being molded of resiliently yieldable plastic and comprising a mounting flange, a cup molded integrally with and projecting from said mounting flange, first and second cantilevered fingers molded integrally with said cup adjacent said pivot means, said fingers being located within said cup and having end portions with opposing ends spaced from one another and spaced laterally from said pivot means, cam means on said frame member for cooperating with said fingers, as said door is swung toward said closed position, to spread said opposing ends of said fingers away from one another in order to flex said fingers and then to allow said opposing ends to spring back toward one another, and detent means on said end portions of said fingers and cooperating with said cam means to press releasably against said cam means as said opposing ends spring back toward one another upon said door reaching said closed position whereby said cam means and said detent means coact to hold said door releasably in said closed position.

2. A hinge as defined in claim 1 in which said cup includes a side wall having a generally arcuate portion and having first and second generally radial portions formed integrally with and extending from said arcuate portion and located adjacent said pivot means, said first and second fingers being generally arcuate and being joined integrally to said first and second radial portions, respectively, said fingers being spaced radially inwardly from and being substantially concentric with said arcuate portion of said side wall.

3. A hinge as defined in claim 1 in which said cam means comprise a nose on said frame member and having a first sloping cam surface for spreading said opposing ends of said fingers and a second and oppositely sloping cam surface for allowing said opposing ends to spring back toward one another.

4. A hinge as defined in claim 3 in which said detent means comprise lugs on the end portions of said fingers, said lugs engaging said first cam surface as said door approaches said closed position and engaging said second cam surface as said door finally reaches said closed position.

5. A hinge as defined in claim 1 in which said cup includes an annular side wall, an outer side and an outer cover, said cover being integrally hinged to said side wall and being swingable from an as-molded position extending from said side wall to a normal position closing the outer side of said cup, and means for holding said cover in said normal position.

6. A concealed self-closing, self-latching hinge for mounting an upright door for swinging outwardly from a closed position to an open position relative to a fixed frame, said hinge comprising a door member and a frame member mountable on said door and frame, respectively, said door member being molded of resiliently yieldable plastic and comprising a mounting flange, a cup molded integrally with and projecting outwardly from said flange, said cup including an annular side wall having a first generally arcuate portion spanning an arc of more than 180 degrees and substantially less than 360 degrees, having generally radially extending portions projecting into said cup from the ends of said arcuate portion, having leg portions projecting from said radially extending portions, and having a second generally arcuate portion extending between the ends of said leg portions, said frame member having a knuckle located between said leg portions, a hinge pin extending through said leg portion and said knuckle and pivotally interconnecting said door member and said frame member to enable said door to swing about an upright axis between said positions, first and second fingers integral with and cantilevered on said radially extending portions of said side wall adjacent said hinge pin, said fingers being generally arcuate and being spaced radially inwardly from said first arcuate portion of said side wall in substantially concentric relation therewith, said fingers having end portions with opposing ends spaced from one another and located adjacent said first arcuate portion about midway along the length thereof, cam means on said frame member in spaced relation with said knuckle for cooperating with said fingers, as said door is swung toward said closed position, to spread said opposing ends of said fingers away from one another in order to flex said fingers and then to allow said opposing ends to spring back toward one another, and lug means on said end portions of said cam fingers and cooperating with said cam means to press releasably against said cam means as said opposing ends spring back toward one another upon said door approaching said closed position thereby to move said door to and hold said door releasably in said closed position.

7. A hinge as defined in claim 6 in which said cam means comprise a nose on said frame member, said nose being generally V-shaped and having first and second oppositely sloping cam surfaces, said lugs engaging said first cam surface and causing the opposing ends of said fingers to spread away from one another as said door is moved toward said closed position, said lugs thereafter engaging and bearing against said second cam surface and causing said door to snap to said closed position as the opposing ends of said fingers spring back toward one another.

8. A hinge as defined in claim 7 in which said cup included an outer side and an outer cover, said cover being integrally hinged to said second arcuate portion of said side wall and being swingable through approximately 180 degrees from an as-molded position extending from said second arcuate portion to a normal position closing the outer side of said cup, and means for holding said cover in said normal position.

9. A concealed self-latching hinge for mounting a door for swinging between open and closed positions on a fixed frame, said hinge comprising a door member and a frame member mountable on said door and said frame, respectively, pivot means pivotally interconnecting said door member and said frame member to enable said door to swing between said positions about a predetermined axis, said door member being molded of resiliently yieldable plastic and comprising a mounting flange, a cup formed integrally with and projecting from said mounting flange, a cantilevered finger molded integrally with said cup and joined to said cup adjacent said pivot means to flex about an axis extending substantially perpendicular to said predetermined axis, said finger being located entirely within said cup and having a free end portion spaced laterally from said pivot means, cam means on said frame member for cooperating with said finger, as said door is swung toward said closed position, to engage the free end portion of said finger in order to flex said finger and then to allow said finger to spring back toward an unflexed position, the free end portion of said finger being resiliently located against said cam means when said door is in its closed position and coacting with said cam means to hold said door releasably in such position.

* * * * *